United States Patent [19]

Holca

[11] 4,305,806

[45] Dec. 15, 1981

[54] ELECTROLYSIS DEVICE

[75] Inventor: Radu Holca, Boulogne, France

[73] Assignee: Degremont, Suresnes, France

[21] Appl. No.: 202,182

[22] Filed: Oct. 28, 1980

[30] Foreign Application Priority Data

Nov. 9, 1979 [FR] France ..... 79 27671

[51] Int. Cl.[3] ..... C25B 9/00; C25B 11/02

[52] U.S. Cl. ..... 204/268; 204/269; 204/270

[58] Field of Search ..... 204/268–270

[56] References Cited

U.S. PATENT DOCUMENTS

| | | | |
|---|---|---|---|
| 3,119,760 | 1/1964 | Foreman et al. | 204/269 |
| 3,402,117 | 9/1968 | Evans | 204/268 |
| 3,960,699 | 6/1976 | Bortak et al. | 204/268 |
| 4,129,494 | 12/1978 | Norman | 204/268 |

*Primary Examiner*—Delbert E. Gantz
*Assistant Examiner*—Donald R. Valentine
*Attorney, Agent, or Firm*—Wenderoth, Lind & Ponack

[57] ABSTRACT

An electrolysis device includes at least two layers of electrodes, each electrode layer including a plurality of bipolar electrodes, each bipolar electrode including a cathode portion and an anode portion. The electrode layers are spaced from each other in parallel planes, and the bipolar electrodes of each electrode layer are arranged in a checkerboard fashion, such that each cathode portion in each electrode layer is spaced from and faces an anode portion in an adjacent cathode layer, thus forming a plurality of electrolytic cells between the electrolytic layers.

18 Claims, 18 Drawing Figures

ELECTROLYSIS DEVICE

BACKGROUND OF THE INVENTION

The present invention is directed to an electrolysis device employing bipolar electrodes which can be used for achieving electrochemical reactions, particularly the electrolysis of a saline solution to obtain an oxidizing solution containing chlorinated compounds, preferably in the form of sodium hypochlorite. Such a solution, having the same range of use as a commercial sodium hypochlorite solution, can be used to chlorinate waters of any type, including waste water, at any stage in the treatment of such water. The oxidizing compounds present in such a solution are measured in "active chlorine equivalents".

Electrolysers utilizing various types of bipolar electrode assemblies are known and are used industrially to achieve various electrochemical reactions. Such known devices, when utilized to obtain a sodium hypochlorite solution from an alkaline metal electrolyte, such as sea water, brackish water, or a sodium chloride solution, result in electrolytic oxidizing and reducing reactions in the immediate vicinity of the electrodes and in chemical reactions between the electrodes. The active chlorine present in the oxidizing solution obtained is dissociated and is found mainly in the form of hypochlorous acid and hypochlorite ions, depending among other things on the pH and the temperature, with simultaneous production of hydrogen. When the electrolyte consists of sea water, the presence of calcium and magnesium salts gives rise to the formation at the cathode of a deposit making it less permeable to the flow of electrons, and periodically requiring acid washing or short-term current inversions.

To avoid such disadvantages, it would be worthwhile on the one hand to limit the concentration of hydrogen formed, as hydrogen is harmful to good maintenance of the electrodes, by eliminating hydrogen during the treatment, and on the other hand to operate at relatively high electrolyte circulation rates between the electrodes in order to reduce the deposits on the cathode and to space or eliminate washing or current inversion operations.

However, to obtain high conversion rates and thus to increase the concentration of active chlorine equivalent in the solution obtained, the current density can be increased. If it is desired to obtain low specific KwH per kg consumption of active chlorine equivalent produced, it is then necessary to employ low voltages, which can be achievied by a reduction of the space between the two electrodes.

Also, during the course of the electrolysis operation, the chemical composition of the electrolyte is modified, thereby necessitating different operating conditions such as speed of the electrolyte between the electrodes and current density.

SUMMARY OF THE INVENTION

The above prior art disadvantages are overcome in accordance with the present invention by the provision of an electrolysis device including at least two layers of electrodes, each electrode layer comprising a plurality of bipolar electrodes, each bipolar electrode including a cathode portion and an anode portion. The electrode layers are spaced from each other in parallel planes and the bipolar electrodes of each electrode layer are arranged in a "checkerboard fashion", such that each cathode portion in each electrode layer is spaced from and faces an anode portion in an adjacent electrode layer, thereby forming a plurality of electrolytic cells between the electrode layers. A pair of end plates formed of insulating material enclose therebetween the electrode layers and the electrolytic cells. Terminals are provided for connecting the electrodes to a power source. As employed herein, the term "checkerboard fashion" means that the bipolar electrodes in a given electrode layer are arranged such that the cathode portions and the anode portions are arranged in a pattern like that of a checkerboard.

The end plates close therebetween the electrolytic cells and electrode layers in a manner similar to that in a "press filter". This arrangement makes it possible to obtain an electrolytic efficiency well above normal prior art electrolytic efficiency and hence reduces specific KwH/kg consumption of active chlorine equivalent produced, allows operation at different current densities in different chambers of the electrolyser, and assures an effective mixing of the compounds on leaving the chambers.

The terminals preferably comprise at least one monopolar electrode in at least one of the electrode layers. The electrolysis device, including bipolar electrodes and equipped with monopolar terminal electrodes, according to the present invention essentially includes a plurality of electrolytic cells, each comprising at least two successive layers of bipolar electrodes, and all of the bipolar electrodes and monopolar terminal electrodes are enclosed between the nonconducting support or end plates. The anode and cathode portions of the bipolar electrodes alternate equally in successive superposed electrode layers.

The bipolar electrodes are supported and positioned in each electrode layer by a plate-shaped member having therein openings receiving the bipolar electrodes. Separating members are positioned between and space adjacent plate-shaped members. The plate-shaped members and the separating members are formed of an insulating material, and the separating members overlap and cover at least a portion of the edges of the bipolar electrodes.

The separating members are positioned between adjacent plate-shaped members to define therebetween a plurality of electrolysis chambers, each chamber including a plurality of tiered electrolytic cells. An electrolyte distribution enclosure is connected to at least one chamber, and an electrolysis product removal enclosure is connected to at least one of the chambers, with the enclosures being connected at opposite sides of the device. The chambers may be connected to each other in series or in parallel, or the chambers may be not connected to each other.

The bipolar electrodes of two adjacent of the chambers between an adjacent pair of the plate-shaped members may have equal active surface areas, or alternatively, may have unequal active surface areas whereby the current densities in the two adjacent chambers will be unequal.

All of the plate-shaped members are flat and of equal thickness, the openings in the plate-shaped members are of the same thickness as the bipolar electrodes, and all of the separating members are of equal thickness.

The openings in the plate-shaped members are rectangular or square shaped, and the electrolytic cells have rectangular or square cross-sections.

BRIEF DESCRIPTION OF THE DRAWINGS

Other objects, features, and advantages of the present invention will be apparent from the following detailed description, taken with the accompanying drawings, wherein.

DETAILED DESCRIPTION OF THE INVENTION

Figure 1:
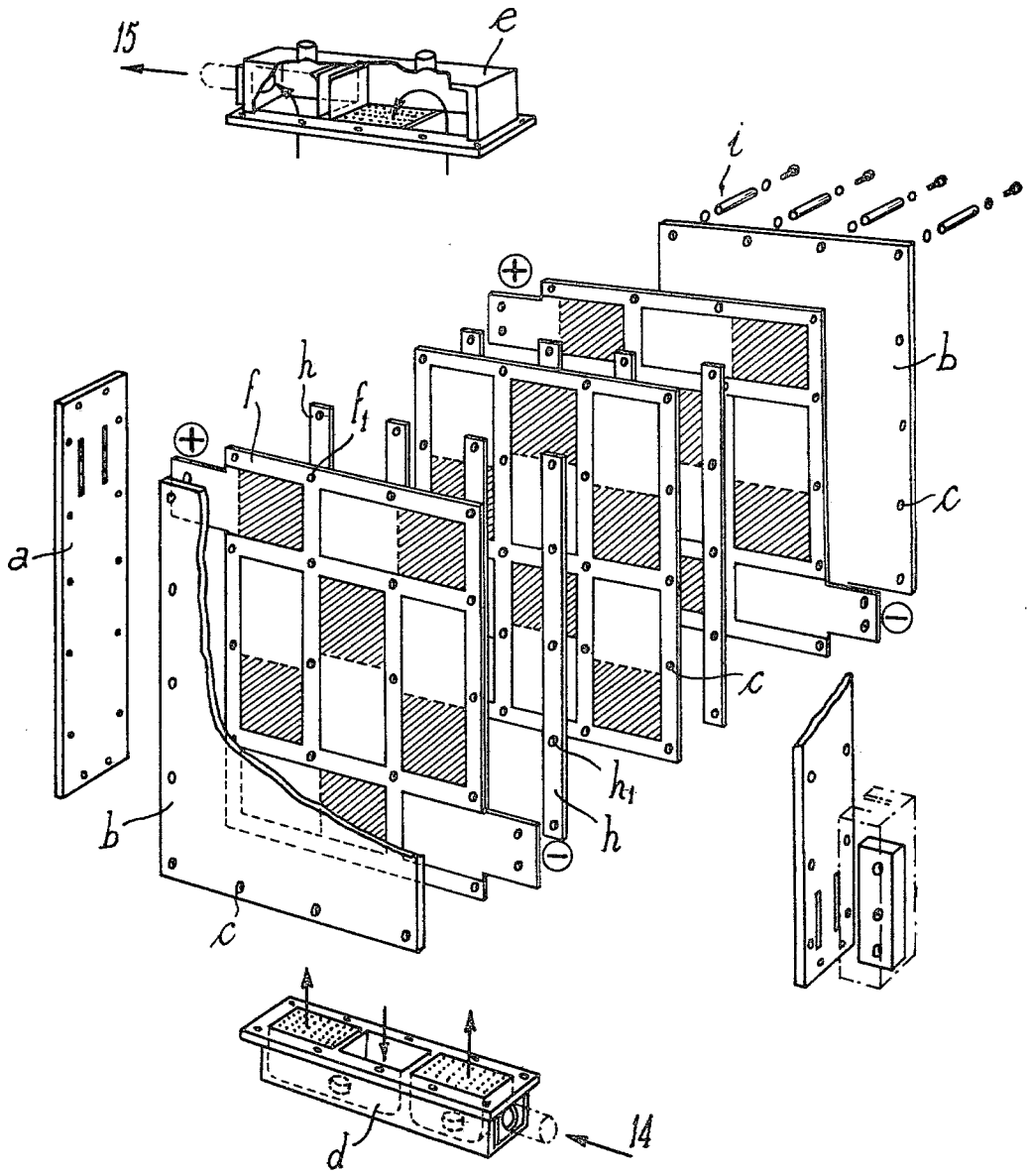
FIG. 1 is an exploded perspective view of an electrolysis device according to the present invention.

With reference now to the drawings, certain preferred arrangements of the present invention will be described in detail. It is to be understood, however, that the specific constructional arrangements illustrated in the drawings are intended to be illustrative of the present invention and not limiting thereto.

As shown in the drawings, the electrolysis device of the present invention is aligned vertically and has a generally right-angled parallelepiped configuration and is formed by a plurality of successive layers of electrodes arranged in parallel successive planes. The device includes a pair of lateral plates a and end or support plates b, both having therethrough holes c for connection purposes. The bottom edge of the device is enclosed by an electrolyte distribution enclosure d and the upper edge of the device is enclosed by an electrolysis product removal enclosure e. Elements a, b, d and e form an enclosure or housing which surrounds and encloses the electrode layers.

Within such housing are arranged a plurality of electrode holding devices in the form of plate-shaped members f which are provided with holes f1 and which may have various shapes for reasons discussed in more detail below. Each of the plate-shaped members f have therethrough a plurality of recesses or openings g for receiving and accommodating electrodes, both bipolar and monopolar in accordance with various possible arrangements of the present invention. Openings g are generally rectangular or square shaped and are arranged in various patterns or configurations depending upon the intended arrangement of the electrodes in a given electrode layer. The size and dimensions of the openings g correspond to the respective dimensions and size of the electrodes received in the recesses.

Plate-shaped members f are, as particularly illustrated in FIG. 1, spaced by means of intercalary or separating members h having therein holes h1 at positions to align with holes f1 of plate-shaped members f and holes c of end plates b. The device is assembled such that the end plates b, the plate-shaped members f and the separating members h are tightened together in a manner similar to that of assembling the filtering plates in a press filter by means of any convenient connecting system, for example, by means of the screw-nut assemblies i.

The plate-shaped members f and the separating members h are formed of an insulating material which is suitable and adapted to the particular operating conditions involved in a particular electrolysis device, such as temperature, aggressiveness of the solutions, etc. The openings g are of the same depth as the electrodes, generally between 1 and 3 mm if the electrodes are metal, and between 4 and 5 mm if the electrodes are graphite, for example. The separating members h are preferably between 1.5 and 4 mm thick. Such thicknesses are however intended to be exemplary only and not limiting, since the particular thicknesses involved in a particular electrolysis device will be a function of the operating conditions and the mechanical stability of the electrodes. However, in a given device, all recesses must be of the same thickness, and all separating members h must be of the same thickness.

The width of the separating members h is slightly greater than the spacing between two adjacent openings g, for example 3 to 6 mm. This makes it possible, upon superimposition and tightening of the electrode layers, to cover at least a portion of the edges of the electrodes and to thus rigidly fix the electrodes within the respective openings g.

Figure 6:
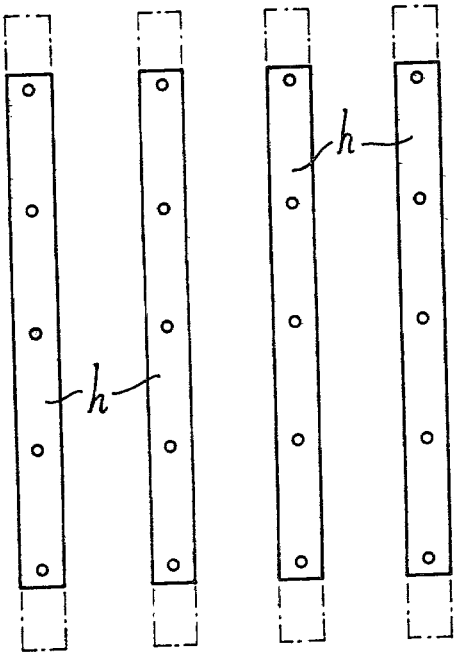
FIG. 6 is an elevation view of intercalary or separating members shown in FIG. 1.
Figure 5:
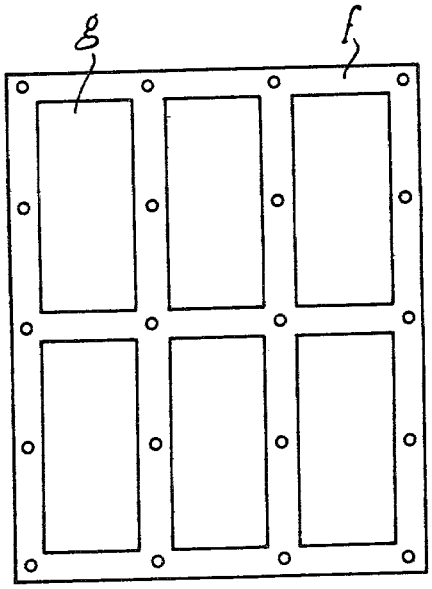

As shown in FIG. 6 and as particularly shown in FIGS. 11–13, the separating members h are of a length such that they form an internal partitioning between adjacent electrode layers to form therein a plurality of chambers k, as will be discussed in more detail below.

The bipolar electrodes, in a suitable number to achieve a particular pattern or arrangement in the electrode layers, are arranged in a "checkerboard fashion" in the plate-shaped members f. As shown in FIGS. 7–10, each bipolar electrode includes a cathode portion C and an anode portion A. The electrode layers are spaced from each other in parallel planes and the bipolar electrodes of each electrode layer are arranged in a suitable checkerboard fashion such that each cathode portion in each electrode layer is spaced from and faces an anode portion in an adjacent electrode layer.

Figure 7:
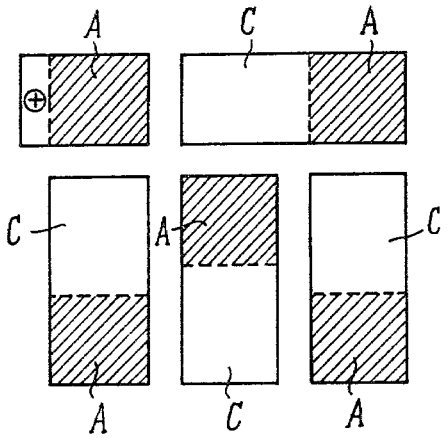
FIGS. 7–10 are elevation views of various arrangements of bipolar electrodes, possibly including monopolar terminal electrodes, according to the present invention.
Figure 8:
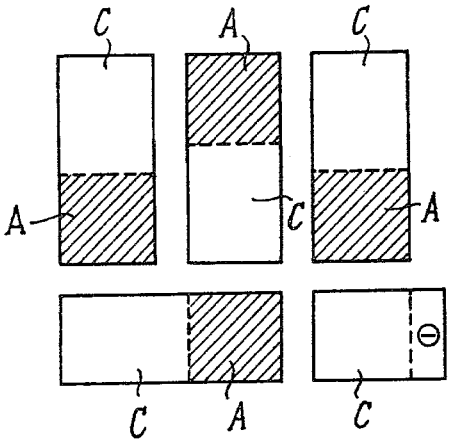

FIGS. 7 and 8 illustrate by way of non-limiting example only the electrode arrangements in adjacent electrode layers. Each electrode layer includes four bipolar electrodes, each having a cathode portion C and an anode portion A. Also in the embodiment of FIGS. 7 and 8, each electrode layer is provided with a monopolar terminal electrode, A in FIG. 7 and C in FIG. 8. The monopolar terminal electrodes in the various successive electrode layers are connected to a suitable power source, such as a direct current power source, by the negative and positive poles. When there is provided a plurality of successively arranged electrode layers as shown in FIGS. 7 and 8, there will be provided a layer of the configuration shown in FIG. 7, then FIG. 8, then again FIG. 7, then again FIG. 8 and so on. By this arrangement, at a given location in the device, there is provided a cathode facing an anode, then such anode facing a cathode, then such cathode facing another anode, and so on. That is, the anodes A and the cathodes C face cathodes C and anodes A, respectively, in adjacent and successive layers.

Figure 1A:
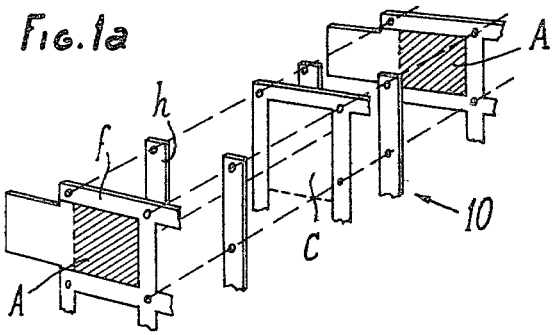
FIG. 1*a* is an exploded perspective view of a cell within the electrolysis device.

The succession in a horizontal plane of facing electrodes of opposite polarity of at least two layers of bipolar electrodes forms an elementary electrolytic cell 10, shown in perspective in FIG. 1*a*. The arrangement in tiers in the vertical direction [with regard to the illustration in the drawings] of a plurality of cells 10 thus formed creates, with the separating members h as described above, a plurality of electrolysis chambers k. The number of electrode layers may be even or odd, but there of course, must be a minimum of two electrode layers. The bipolar and monopolar electrodes of the end-most electrode layers are electrically active only on the side of the electrode surfaces facing a spaced electrode and between which passes electrolyte. The bipolar and monopolar electrodes of intermediate electrode layers are electrically active on both sides of the electrodes.

Figure 9:
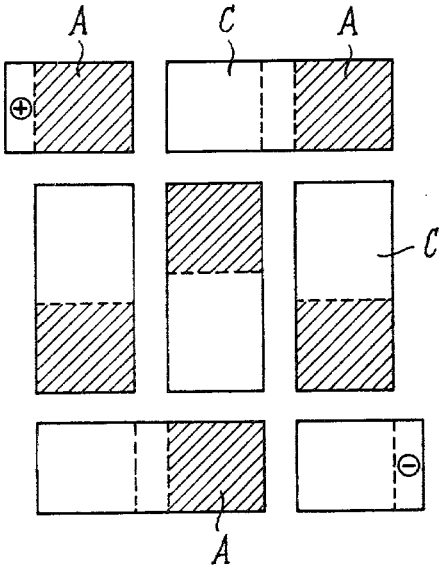
Figure 10:
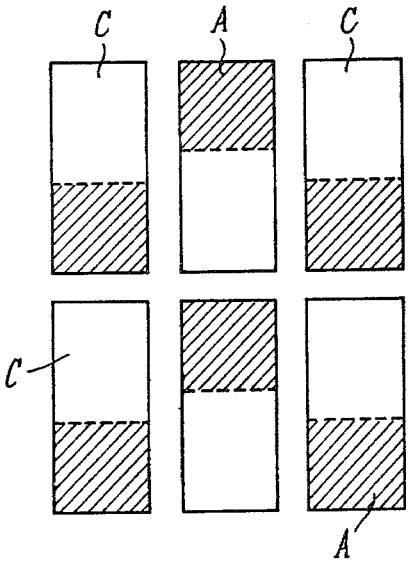

FIGS. 9 and 10 illustrate another possible arrangement of adjacent electrode layers in accordance with the present invention. This arrangement is different from the arrangement of FIGS. 7 and 8, and is the arrangement shown in FIG. 1. Thus, two adjacent electrode layers include one electrode layer formed of five bipolar electrodes and two monopolar terminal electrodes [FIG. 9]. The adjacent electrode layer is formed of six bipolar electrodes [FIG. 10]. The electrolyzer in this arrangement includes three electrolysis chambers k, each chamber having four tiered electrolytic cells, or twelve such elementary electrolytic cells in total, this being the arrangement of FIG. 1.

The anode ends, i.e., positive terminals, shown in FIG. 1 are connected to one another by a connector having good conducting properties forming the positive pole of the electrolyzer. A similar conductor forms the negative pole of the electrolyzer and is connected to the cathode terminals.

Figure 2:
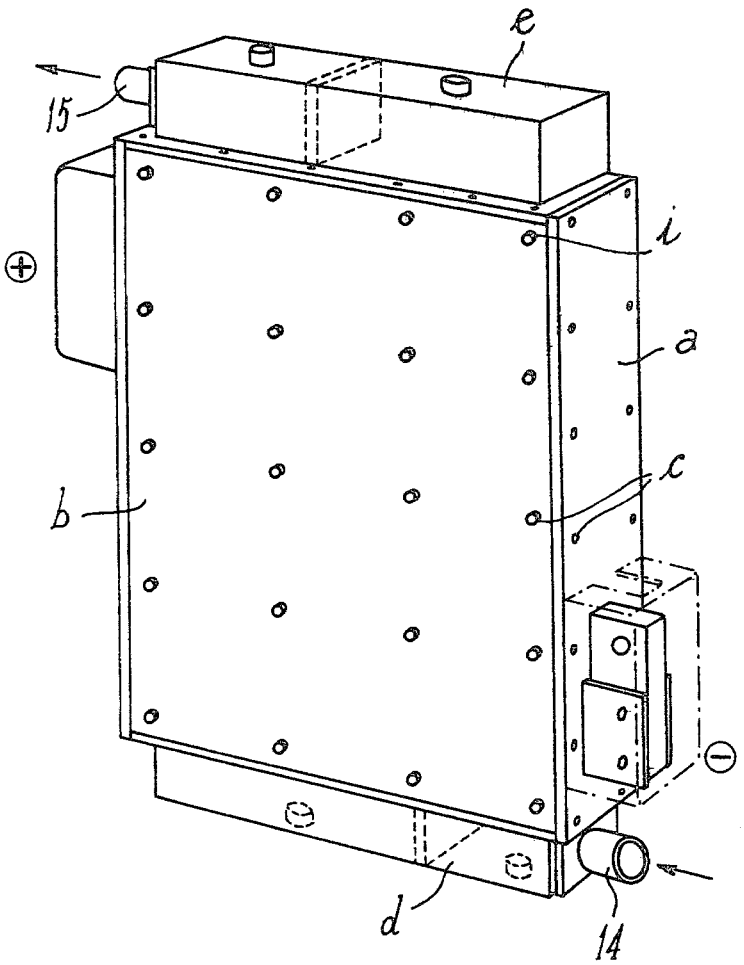
FIG. 2 is a perspective view of the exterior of the device of FIG. 1, but in an assembled condition.
Figure 3:
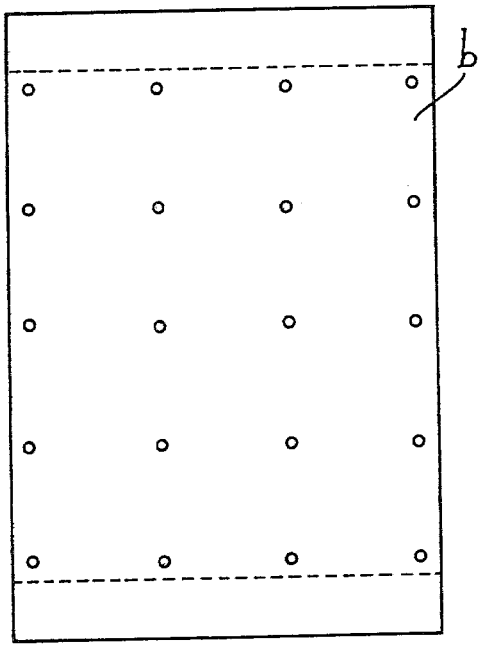
FIG. 3 is an elevation view of an end or support plate of the device shown in FIG. 1.
Figure 4:
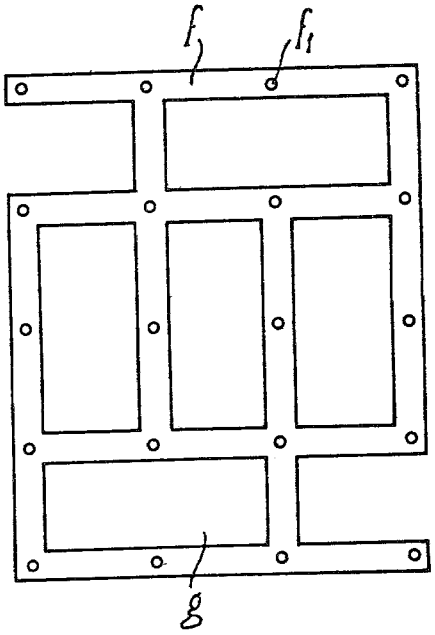
FIGS. 4 and 5 are elevation views of plate-shaped electrode supporting members shown in FIG. 1.

The electrolyte distribution enclosure d and the electrolysis product removal enclosure e are respectively connected to electrolyte inlet conduit 14 and electrolysis product outlet conduit 15, as particularly shown in FIG. 2.

The path of the electrolyte within the interior of the device may be varied as desired depending upon the particular arrangement of the enclosures d and e and the separating members h. FIGS. 11–13 illustrate three possible internal arrangements.

Figure 11:
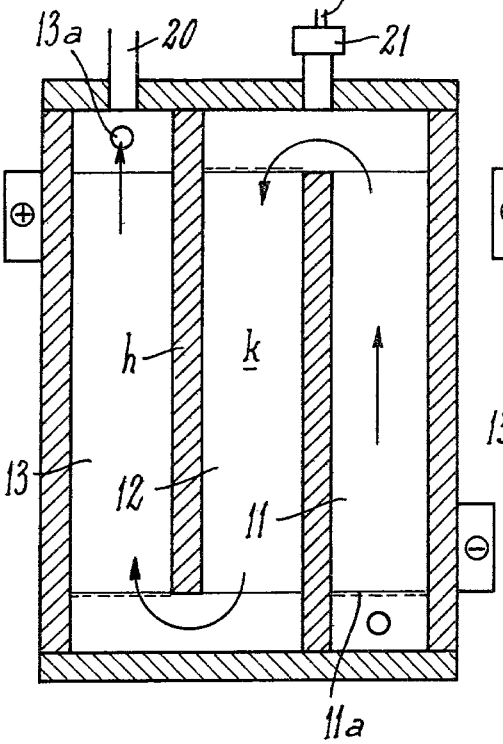
FIGS. 11–13 are diagrammatic sectional views, taken in planes parallel to the electrode layers, of electrolysis chambers formed according to the present invention.

Thus, in FIG. 11, the chambers k are connected in series. Thus, the enclosure d introduces via a distribution device 11*a* the electrolyte into one end of an upstream chamber 11. The electrolyte passes at the opposite end of chamber 11 into an end of a chamber 12, and passes from the opposite end of chamber 12 into a further chamber 13. The electrolysis product or solution is removed as at 13*a* to enclosure e. Discharge pipes 20 for hydrogen may be advantageously equipped with gas-liquid separator devices 21.

Figure 12:
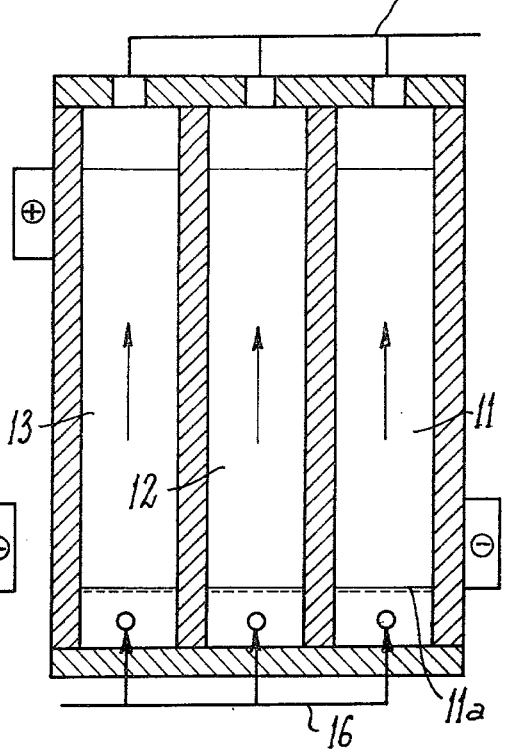

In the arrangement of FIG. 12, the chambers 11–13 are not connected with each other, the electrolyte is supplied as at 16 to lower ends of all of chambers 11–13, and the electrolysis product or solution is removed from upper ends of all of chambers 11–13, as indicated at 17.

Figure 13:
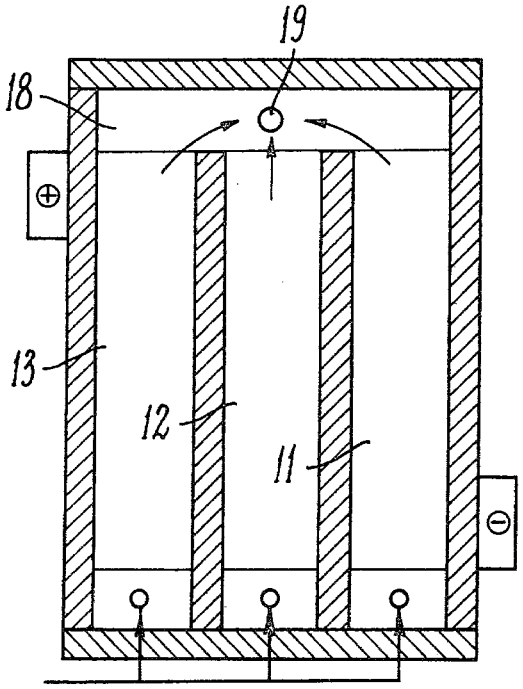
Figure 15:
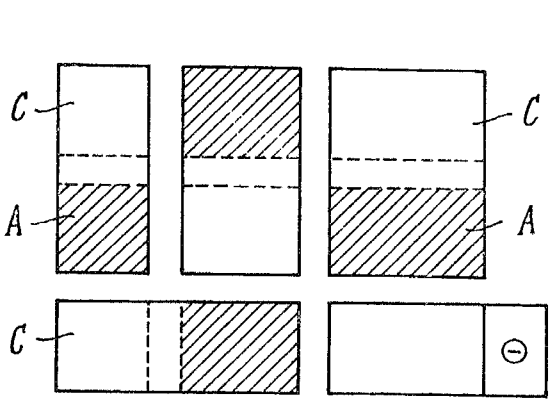
FIGS. 14 and 15 are views similar to FIGS. 7–10, but illustrating electrode arrangements wherein the electrodes are dimensioned to have areas of differing active surface areas.
Figure 17:
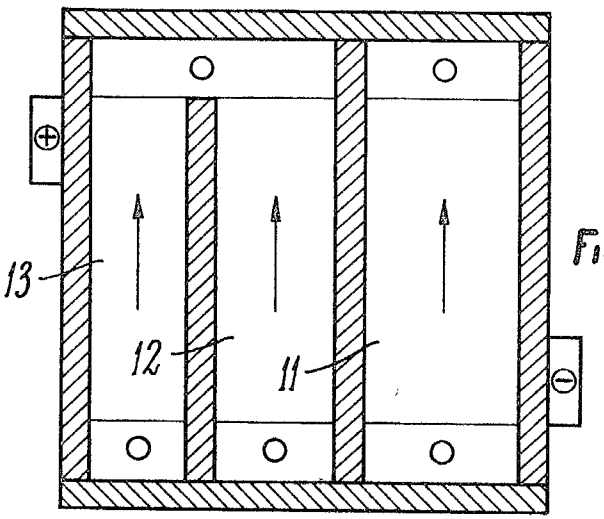
FIGS. 16 and 17 are views similar to FIGS. 11–13, but incorporating the electrode arrangements of FIGS. 14 and 15, respectively.
Figure 14:
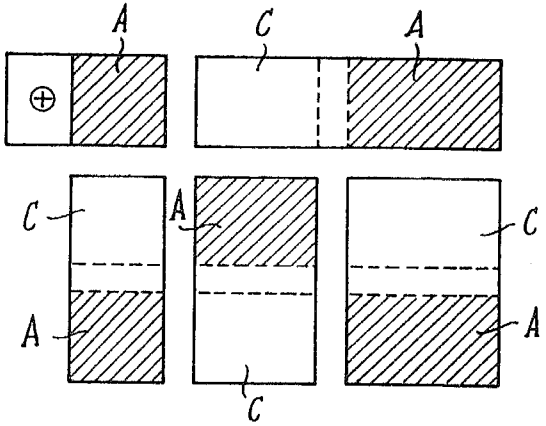
Figure 16:
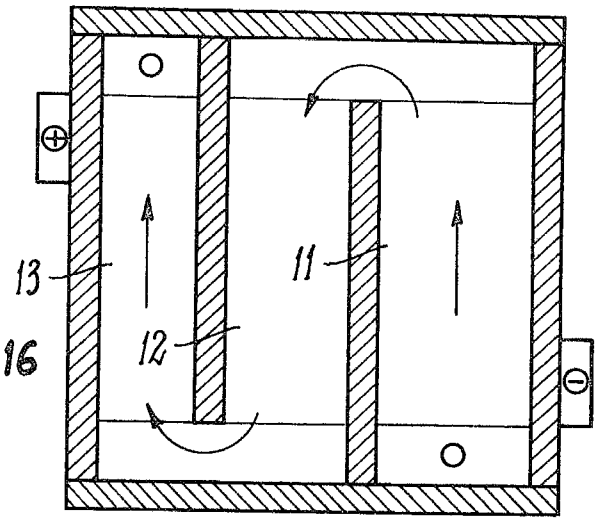

The arrangement of FIG. 13 is somewhat similar to that of FIG. 12, in that the electrolyte is supplied to lower ends of all of chambers 11–13. However, the chambers communicate with each other via a common enclosure 18 at the upper portions of the chambers, such that the electrolysis product or solution is removed from a common discharge as at 19.

In the arrangements of FIGS. 12 and 13, the chambers 11–13 can be fed individually by electrolytes of various types. This type of arrangement can also be employed when the electrolysis product from the chamber 11 is to be mixed with an electrolysis product obtained from another chamber, for example, chamber 12 or chamber 13.

The above previous discussion of the present invention involves arrangements whereby the active surface areas of the bipolar electrodes of two adjacent chambers are equal.

However, FIGS. 14–17 illustrate an arrangement whereby the active surface areas of the bipolar electrodes in two adjacent chambers are unequal. Thus, it will be apparent that the active surface area of the electrodes in chamber 11 is less than the active surface area of the electrodes in chamber 12, which in turn is less than the active surface area of the electrodes in chamber 13. By this arrangement, the current density in chamber 13 will be less than the current density in chamber 12, and the current density in chamber 12 will be less than the current density in chamber 11. It of course will be apparent that the chambers of FIGS. 14–17 may be arranged in different positions within the electrolyzer than as illustrated.

The internal electrical connection of the electrodes in a single electrolyzer is in parallel or series. The voltage across the electrolyzer, by the positive and negative poles, is a function of the voltage per elementary cell multiplied by the number of cells. The current intensity is a function of the current density at which the electrolyzer operates multiplied by the sum of the active anode and cathode surfaces of the electrodes of a cell. The monopolar terminal electrodes, i.e., anodes and cathodes, may be opposite or at the same level below or the same level above the electrolyzer, or may be at different levels, with the anode above and the cathode below, or vice cersa. Several electrodes can be hydraulically connected in series or parallel. The electrical connection of several identical electrolyzers is preferably in series.

The electrolysis device of the present invention has a number of advantages over known such devices. Thus, since the edges of the bipolar electrodes are protected by the openings in the plate-shaped members f, there will be no escape of current from one electrode to an adjacent electrode in the same plane or layer. Additionally, destruction of an electrode at the level of the electrode edges, which in known devices are normally covered with considerable difficulty by a noble metal such as platinum or iridium, is avoided since at least a portion of the edges of the electrodes are covered by the separating members h whereby such electrode edges are not exposed to the electrolysis phenomenon. Also, it is possible to use mass produced standard equipment requiring no soldering, thereby facilitating manufacture in connection with the device according to the invention. In addition, if it is desired to increase the production of the device, complimentary layers of electrodes identical to existing electrodes can easily be added. Further, electrode layers can be removed from operation in a given device by merely placing fully insulating plates or layers in place of some of the existing electrode layers.

Furthermore, the configuration of the electrolyzer described above makes it possible to utilize flat electrodes:

Regardless of material or materials used in manufacturing the electrodes, as long as the electrodes are current conducting and are adapted to the particular electrochemical conditions of use;

Regardless of the electrode thickness, since the non-conducting plate-shaped members f are adapted to the particular conditions of the planned electrolysis operation and have the same thickness as the electrodes;

Regardless of the distance between two adjacent electrode layers, since the non-conducting separating members h are generally of the same material as that used for the plate-shaped member f and are suitably sized to achieve the desired spacing;

Regardless of the type of electrodes employed, that is whether the electrodes have full or striated surfaces, as long as the electrodes are flat;

Regardless of the the surface of the electrodes, as long as the above discussed electrode conditions are met.

Additionally, the present invention provides the advantage of increasing the over all efficiency of a complete installation, since it is possible on the one hand to improve the efficiency of the electrolysis operation proper, while reducing the power required across the electrolyzer, and on the other hand, to reduce losses of an electrochemical nature involving more especially losses through the Joule effect in the bars, connections, cooling auxiliaries, etc. This is achieved by using bipolar electrodes forming plural cells requiring an over all current density much lower than that necessary for a similar electrolyzer employing only mono cells. Additionally, the voltage applied across the cell is lower than that applied in known devices, since the checkerboard arrangement of the spaced electrodes makes it possible to reduce the distance between electrodes and consequently the resistance of the electrolyte. A better electrode level is also thus obtained with respect to time, particularly when employing voltage-sensitive anodes. For given power consumed and with the same efficiencies, the electrolyzer according to the present invention has the advantage of operating at a low over all current density and at a relatively high voltage across the electrolyzer [V=v X number of cells]. This results in a lower price for the transformer-rectifier equipment, since the price of the latter for the same power is lower when current is lower and voltage is higher.

It is specifically to be understood that the present invention is adapted to be employed in any type of electrolysis device of the general type described. It is not intended that the present invention be restricted to any particular electrode size, electrode number, electrolyzer size, electrolyte, electrode spacing. Rather, it is intended that the present invention be applied to all such known parameters and other operational parameters as would be understood by those skilled in the art.

Although the present invention has been described and illustrated with respect to specific arrangements thereof, it is to be understood that various modifications may be made to the specifically described and illustrated arrangements without departing from the spirit and scope of the present invention.

What is claimed is:

1. An electrolysis device comprising:

at least two layers of electrodes, each said electrode layer comprising a plurality of bipolar electrodes, each said bipolar electrode including a cathode portion and an anode portion;

said electrode layers being spaced from each other in parallel planes, and said bipolar electrodes of each said electrode layer being arranged in a checkerboard fashion, such that each said cathode portion in each said electrode layer is spaced from and faces a said anode portion in an adjacent said electrode layer, thereby forming a plurality of electrolytic cells between said electrode layers;

a pair of end plates formed of insulating material and enclosing therebetween said electrode layers and said electrolytic cells; and terminal means for connecting said electrodes to a power source.

2. A device as claimed in claim 1, wherein said terminal means comprises at least one monopolar electrode in at least one said electrode layer.

3. A device as claimed in claim 1, further comprising holding means for supporting and positioning said bipolar electrodes of each said electrode layer.

4. A device as claimed in claim 3, wherein said holding means comprises for each said electrode layer a plate-shaped member having therein openings receiving said bipolar electrodes, and separating members positioned between and spacing adjacent said plate-shaped members, said end plates enclosing therebetween said plate-shaped members and said separating members.

5. A device as claimed in claim 4, wherein said plate-shaped members and said separating members are formed of insulating material, and said separating members overlap and cover at least a portion of the edges of said bipolar electrodes.

6. A device as claimed in claim 4, wherein said separating members are positioned between adjacent said plate-shaped members to define therebetween a plurality of electrolysis chambers, said chamber comprising a plurality of tiered said electrolytic cells, and further comprising supply means for supplying electrolyte to at least one said chamber, and collecting means for removing an electrolysis product from at least one of said chambers.

7. A device as claimed in claim 6, wherein said chambers are connected in series.

8. A device as claimed in claim 6, wherein said chambers are connected in parallel.

9. A device as claimed in claim 6, wherein said chambers are not connected, and said supply means and said collecting means are connected to all of said chambers.

10. A device as claimed in claim 6, wherein said bipolar electrodes of two adjacent said chambers between an adjacent pair of said plate-shaped members have equal active surface areas.

11. A device as claimed in claim 6, wherein said bipolar electrodes of two adjacent said chambers between an adjacent pair of said plate-shaped members have unequal active surface areas, whereby the current densities in said two adjacent chambers will be unequal.

12. A device as claimed in claim 6, wherein said supply means comprises an electrolyte distribution enclosure, said collecting means comprises an electrolysis product removal enclosure, said enclosures each being connected to at least one of said chambers at opposite sides of said device.

13. A device as claimed in claim 4, wherein all said plate-shaped members are flat and of equal thickness.

14. A device as claimed in claim 4, wherein said openings in said plate-shaped members are of the same thickness as said bipolar electrodes.

15. A device as claimed in claim 4, wherein all said separating members are of equal thickness.

16. A device as claimed in claim 4, wherein said openings in said plate-shaped members are rectangular or square shaped.

17. A device as claimed in claim 1, having a generally right-angled parallelepiped configuration.

18. A device as claimed in claim 1, wherein each said electrolytic cell has a rectangular or square cross-section.

* * * * *